US009700088B2

(12) United States Patent
Baehr et al.

(10) Patent No.: US 9,700,088 B2
(45) Date of Patent: Jul. 11, 2017

(54) APPAREL APPLICATION AID

(71) Applicants: Aimee Hayden Baehr, Sicklerville, NJ (US); Christopher Joseph Baehr, Sicklerville, NJ (US)

(72) Inventors: Aimee Hayden Baehr, Sicklerville, NJ (US); Christopher Joseph Baehr, Sicklerville, NJ (US)

( * ) Notice: Subject to any disclaimer, the term of this patent is extended or adjusted under 35 U.S.C. 154(b) by 1058 days.

(21) Appl. No.: 13/849,959

(22) Filed: Mar. 25, 2013

(65) Prior Publication Data

US 2013/0247278 A1 Sep. 26, 2013

Related U.S. Application Data

(60) Provisional application No. 61/615,324, filed on Mar. 25, 2012.

(51) Int. Cl.
*A41D 27/08* (2006.01)

(52) U.S. Cl.
CPC ..... *A41D 27/08* (2013.01); *A41D 2400/44* (2013.01)

(58) Field of Classification Search
CPC ..... A41D 27/08; A41D 2400/44
See application file for complete search history.

(56) References Cited

U.S. PATENT DOCUMENTS 3,906,642 A * 9/1975 Cohen ..... A43B 1/0027 36/112
4,344,240 A * 8/1982 Schiller ..... G09F 3/04 24/108
6,142,785 A * 11/2000 Williams ..... G09B 19/02 2/159
D640,447 S * 6/2011 Bengyak ..... D2/617
2002/0020082 A1* 2/2002 James ..... A43B 3/0078 36/112
2005/0223600 A1* 10/2005 Hunter ..... A43B 3/0078 36/112
2007/0245598 A1* 10/2007 Pawsey ..... A43B 1/0054 36/136
2010/0047747 A1* 2/2010 Errigo ..... A41B 11/002 434/130
2015/0033578 A1* 2/2015 Hodson ..... A43B 17/00 36/43
2016/0015115 A1* 1/2016 Hammond ..... A43B 3/0094 36/83

* cited by examiner

*Primary Examiner* — Shaun R Hurley
*Assistant Examiner* — Andrew W Sutton

(57) ABSTRACT

Appropriately placed objects may aid in applying various types of apparel. A first object may be placed on left footwear/handwear and a second object may be placed on right footwear/handwear. An object that is similar looking to the first object may be placed on the left side of apparel. An object similar looking to the second object may be placed on the right side of apparel. An orientation for donning the footwear/handwear may be determined based on the location of the objects and the similarity between objects.

12 Claims, 14 Drawing Sheets

APPAREL APPLICATION AID

CROSS REFERENCE TO RELATED APPLICATIONS

The instant application claims priority to U.S. provisional patent application No. 61/615,324, filed Mar. 25, 2012, titled "Apparel Application Aid." U.S. provisional patent application No. 61/615,324 is incorporated by reference herein in its entirety.

TECHNICAL FIELD

The technical field relates generally to applying garments, and more specifically to an aid for applying footwear and handwear.

BACKGROUND

It is not uncommon for a person to struggle when trying to determine which foot or hand a shoe or glove should be placed. For example, children, elderly persons, persons of limited mental capacity, persons with impaired vision, or the like, may struggle trying to determine which shoe goes on the left foot and which shoe goes on the right foot. Also, for some styles of footwear (e.g., boots, sandals) and handwear (e.g., mittens), it may be difficult to discern the right from the left.

SUMMARY

Appropriately placed objects may aid in applying various types of clothing/garments. In an example embodiment, a first object may be placed on left footwear (e.g., shoe, boot, slipper, sandal, etc.) and a second object may be placed on right footwear. An object that is similar looking to the first object may be placed on the left side of apparel (e.g., pant leg, skirt hem, etc.). An object similar looking to the second object may be placed on the right side of apparel.

Similarly, a first object can be placed on left handwear (e.g., glove, mitten, jewelry, etc.) and a second object can be placed on right handwear. An object that is similar looking to the first object can be placed on the left sleeve of apparel (e.g., shirt, jacket, sweater, etc.) and an object similar looking to the second object can be placed on the right sleeve of apparel.

The first object and the second object are distinctive enough such that a difference between the first object and the second object may be readily recognized. For example, the first object and the second object may be distinctive enough such that a child, person of limited mental capacity, elderly person, person with impaired vision, or the like, may easily recognize the difference between the first object and the second object.

In an example embodiment, objects may be placed on only one side (left or right) of clothing/garments to distinguish left from right.

In another example embodiment, objects may be placed on only one side (left or right) of footwear/handwear to distinguish left from right.

In an example application, when putting on footwear or handwear, the first object is compared with the objects on the apparel. When an object on the apparel matches the object on the footwear or handwear, the wearer knows that the footwear or handwear is to be placed on the foot or hand corresponding to the side of the apparel that matches.

Objects may be color coded, shaped, personalized, and/or comprise any appropriate number of objects in order to aid in distinguishing first objects from second objects, and to compare similar looking objects. Objects may have tactile differences such that a difference between objects may be ascertainable via touch. Objects may have aromatic differences such that a difference between objects may be ascertainable via olfactory senses (e.g., sense of smell). Objects may comprise audible differences such that a difference between objects may be ascertainable via auditory senses (e.g., sense of hearing). Object may comprise light emitting differences (e.g., flashing lights, etc.) such that a difference between objects may be ascertainable via visual senses.

Objects may be placed on footwear, handwear, and/or other apparel, via any appropriate mechanism, such as, for example, via: adhesive, hook-and-loop fastener (e.g., VELCRO®), sewing, ironing, insertion into a pouch, marker, dye, magnetic fastener, pinned, or any combination thereof. Objects may be permanently attached and/or removeably attached (e.g., pinned).

BRIEF DESCRIPTION OF THE DRAWINGS

The features and advantages of the present disclosure will be best understood when considering the following description in conjunction with the accompanying drawings, of which.

DETAILED DESCRIPTION OF ILLUSTRATIVE EMBODIMENTS

Figure 1:
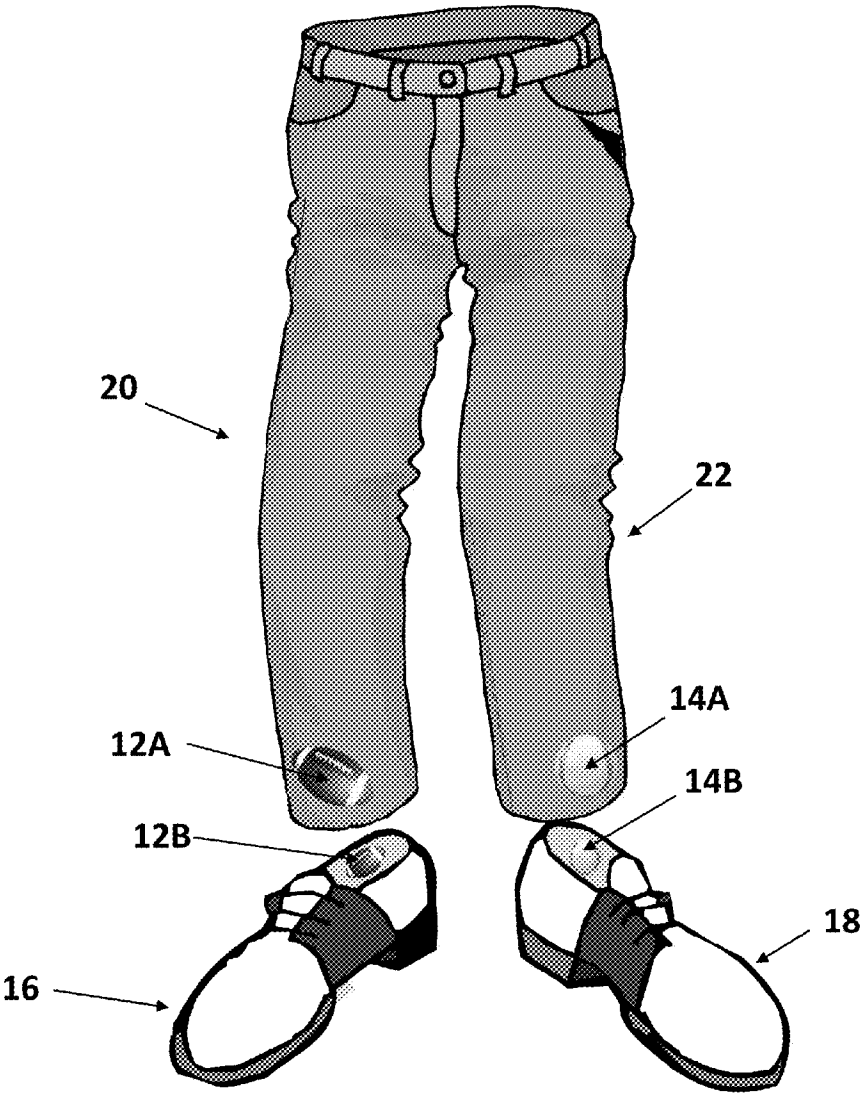
FIG. 1 is an illustration of an example aid for applying footwear.

FIG. 1 is an illustration of an example aid for applying footwear. As depicted in FIG. 1, objects such as example objects 12 and 14 may be placed on a garment at various locations. For example, an object such as object 12A depicting a football may be placed on a right pant leg 20. An object 12B similar in appearance to object 12A may be placed on another garment, such as right shoe 16. Another object, such as object 14A depicting a baseball may be placed on the other (left) pant leg 22. An object 14B similar in appearance to object 14A may be placed on another garment, such as left shoe 18. Subsequent to placement of objects 12 and 14, a person can observe the objects and their respective placements as an aid to determining which foot to place shoes 16 and 18.

Figure 2:
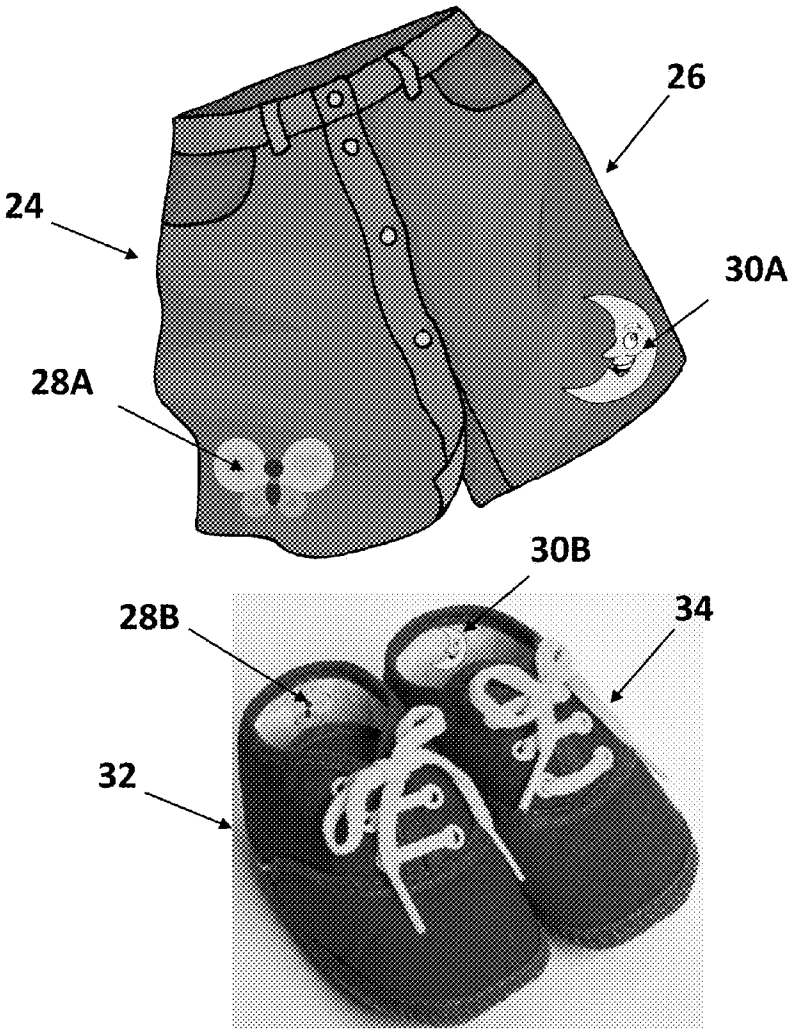
FIG. 2 is another illustration of an example aid for applying footwear.

FIG. 2 is another illustration of an example aid for applying footwear. As depicted in FIG. 2, objects such as example objects 28 and 30 may be placed on a garment at various locations. For example, an object such as object 28A depicting a butterfly, for example, may be placed on a right skirt flap 24. An object 28B similar in appearance to object 28A may be placed on another garment, such as right shoe 32. Another object, such as object 30A depicting a moon may be place on the other (left) skirt flap 26. An object 30B similar in appearance to object 30A may be placed on another garment, such as left shoe 34. Subsequent to placement of objects 28 and 30, a person can observe the objects and their respective placements as an aid to determining which foot to place shoes 32 and 34. An object, or objects, may be placed on a strap, a shoelace, or the like, of footwear, or any appropriate combination thereof (placement on strap/shoelace not depicted in FIG. 2).

Figure 3:
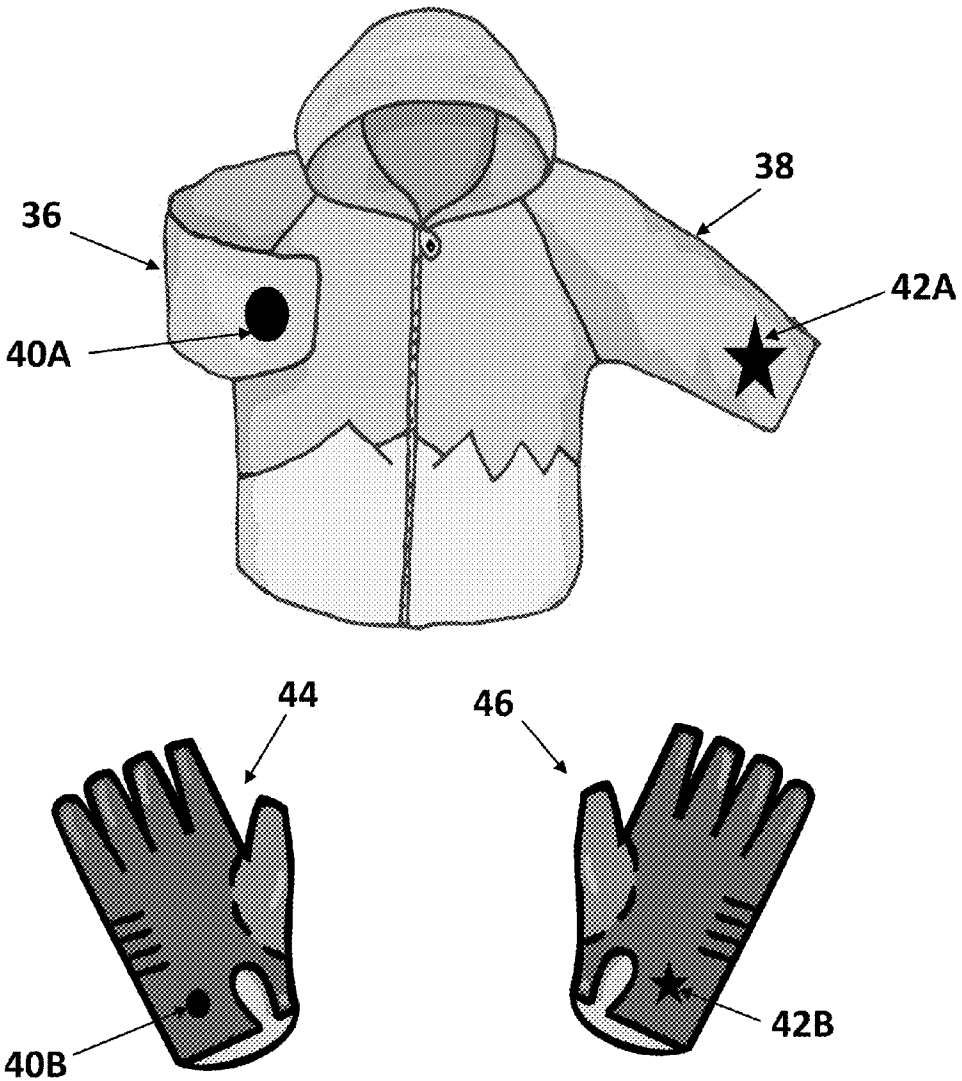
FIG. 3 is an illustration of an example aid for applying handwear.

FIG. 3 is an illustration of an example aid for applying handwear. As depicted in FIG. 3, objects such as example objects 40 and 42 may be placed on a garment at various locations. For example, an object such as object 40A depicting an example shape (e.g., oval), may be placed on a right sleeve 36. An object 40B similar in appearance to object 40A may be placed on another garment, such as right glove 44. Another object, such as object 42A depicting another example shape (e.g., star) may be placed on the other (left) sleeve 38. An object 42B similar in appearance to object 42A may be placed on another garment, such as left glove 46. Subsequent to placement of objects 40 and 42, a person can observe the objects and their respective placements as an aid to determining which hand to place gloves 44 and 46.

Figure 4:
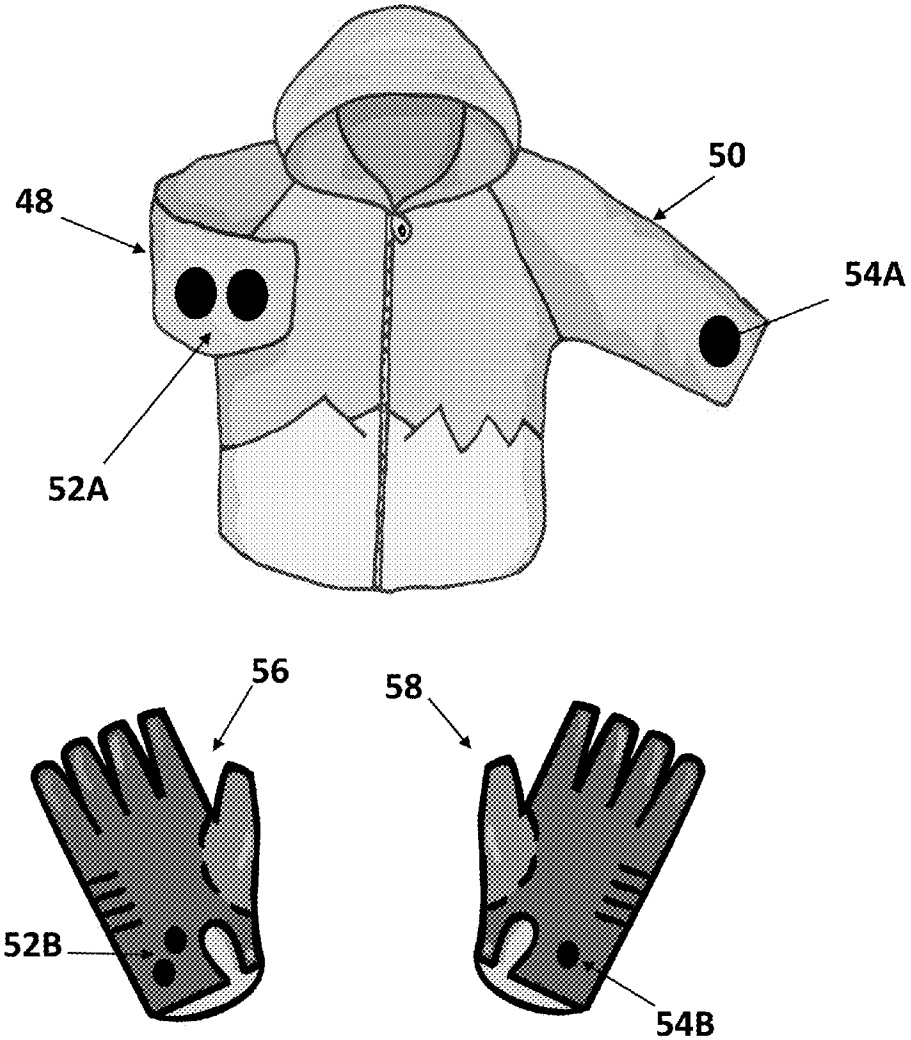
FIG. 4 is another illustration of an example aid for applying handwear.

FIG. 4 is another illustration of an example aid for applying handwear. As depicted in FIG. 4, objects such as example objects 52 and 54 may be placed on a garment at various locations. For example, an object such as object 52A depicting an example shape (e.g., two ovals), may be placed on a right sleeve 48. An object 52B similar in appearance to object 52A may be placed on another garment, such as right glove 56. Another object, such as object 54A depicting another example shape (e.g., single oval) may be placed on the other (left) sleeve 50. An object 54B similar in appearance to object 54A may be placed on another garment, such as left glove 58. Subsequent to placement of objects 52 and 54, a person can observe the objects and their respective placements as an aid to determining on to which hands to place gloves 56 and 58.

Figure 5:
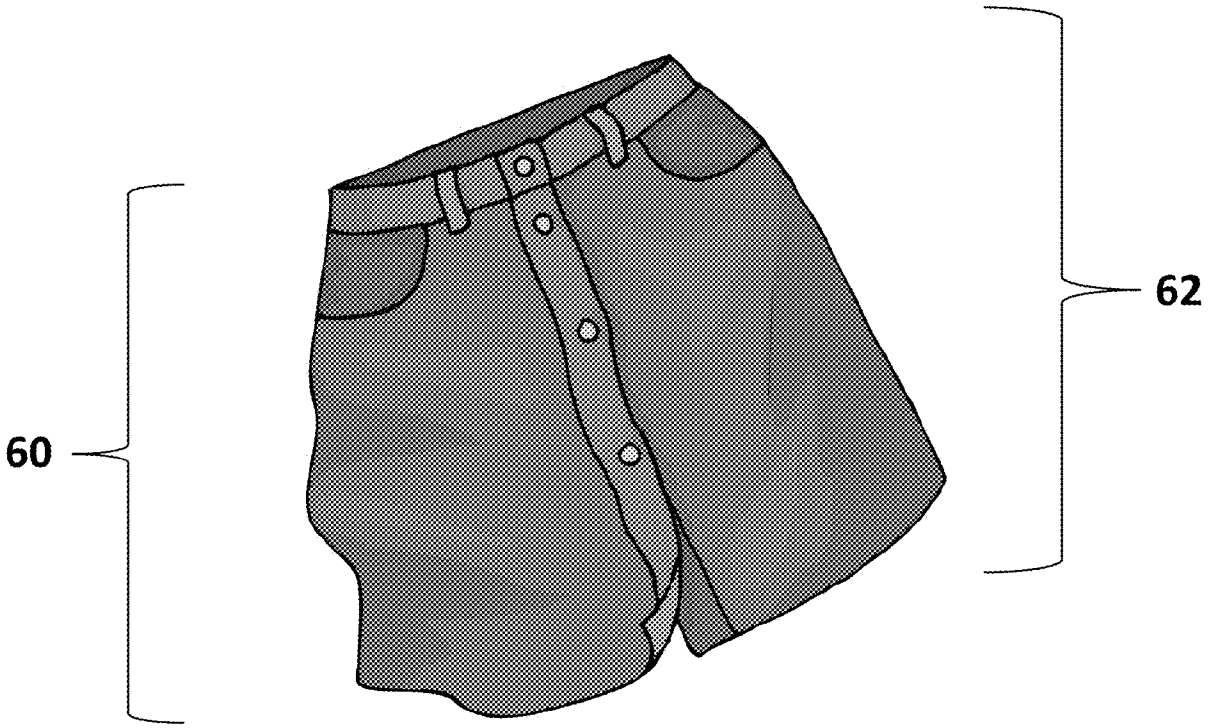
FIG. 5 is an illustration of example placement of objects.

FIG. 5 is an illustration of example placement of objects. As depicted in FIG. 5, objects may be placed on various portions of a garment, such as, for example, the right side 60 and/or the left side 62 of the skirt depicted in FIG. 5.

Figure 6:
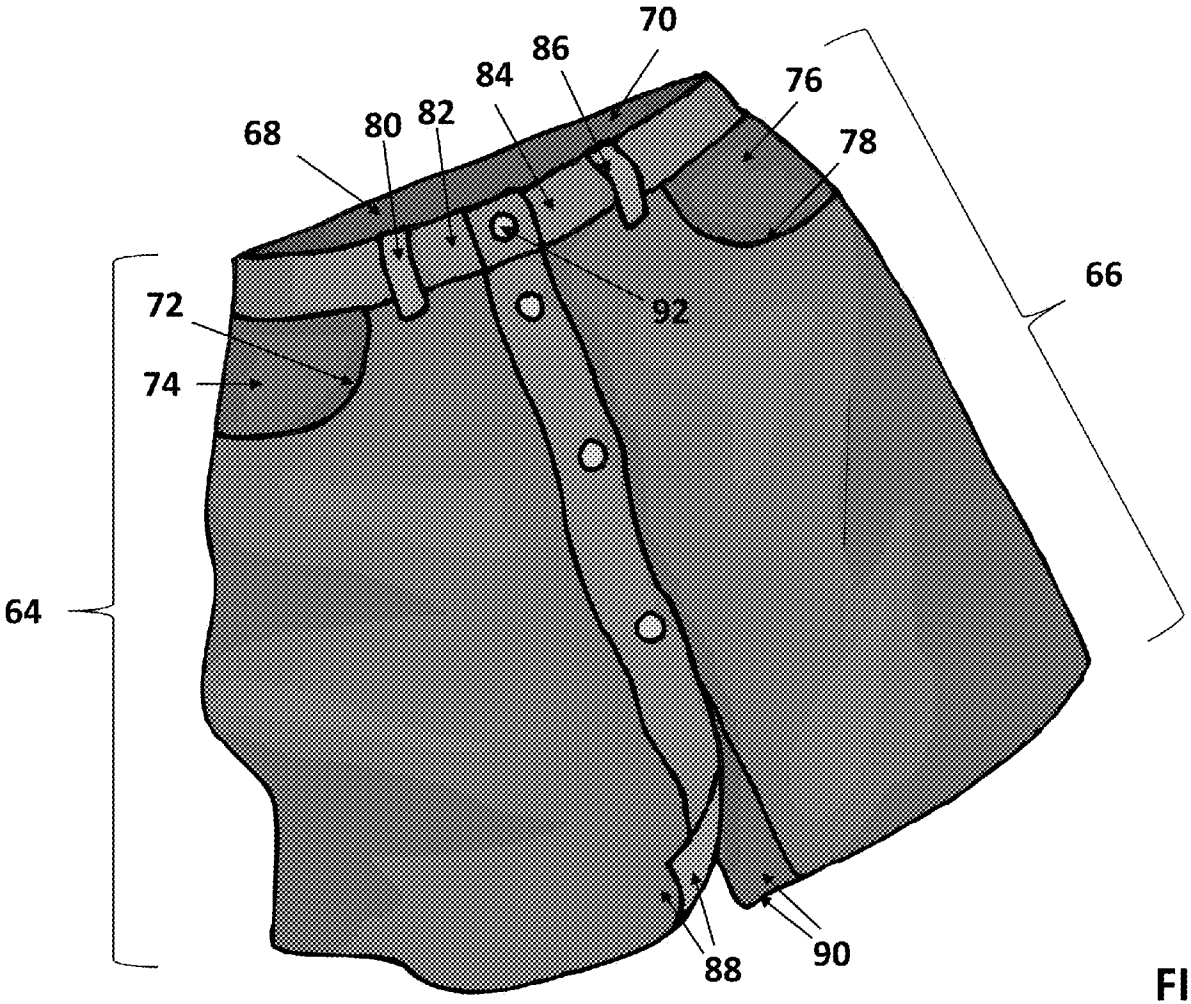
FIG. 6 is another illustration of example placement of objects.

FIG. 6 is another illustration of example placement of objects. As depicted in FIG. 6, objects may be placed on various portions of a garment, such as, for example, the right side 64 and/or the left side 66 of the skirt depicted in FIG. 6. Objects may be placed at any appropriate location, such as, for example, approximate to the right pocket (72, 74), approximate to the left pocket (76, 78), approximate to right side inner waste band 68 (back and/or front), approximate to left side inner waste band 70 (back and/or front), approximate to right side outer wasted band 82 (back and/or front), approximate to left side outer waste band 84 (back and/or front), approximate to right side belt loop 80 (any appropriate belt loop or combination of belt loops), approximate to left side belt loop 86 (any appropriate belt loop or combination of belt loops), approximate to fastener (e.g., button, snap, zipper, tie, pile and hook, etc.) 92, approximate to right side inner and/or outer flap 88, approximate to left side inner and/or outer flap 90, or any appropriate combination thereof.

Figure 7:
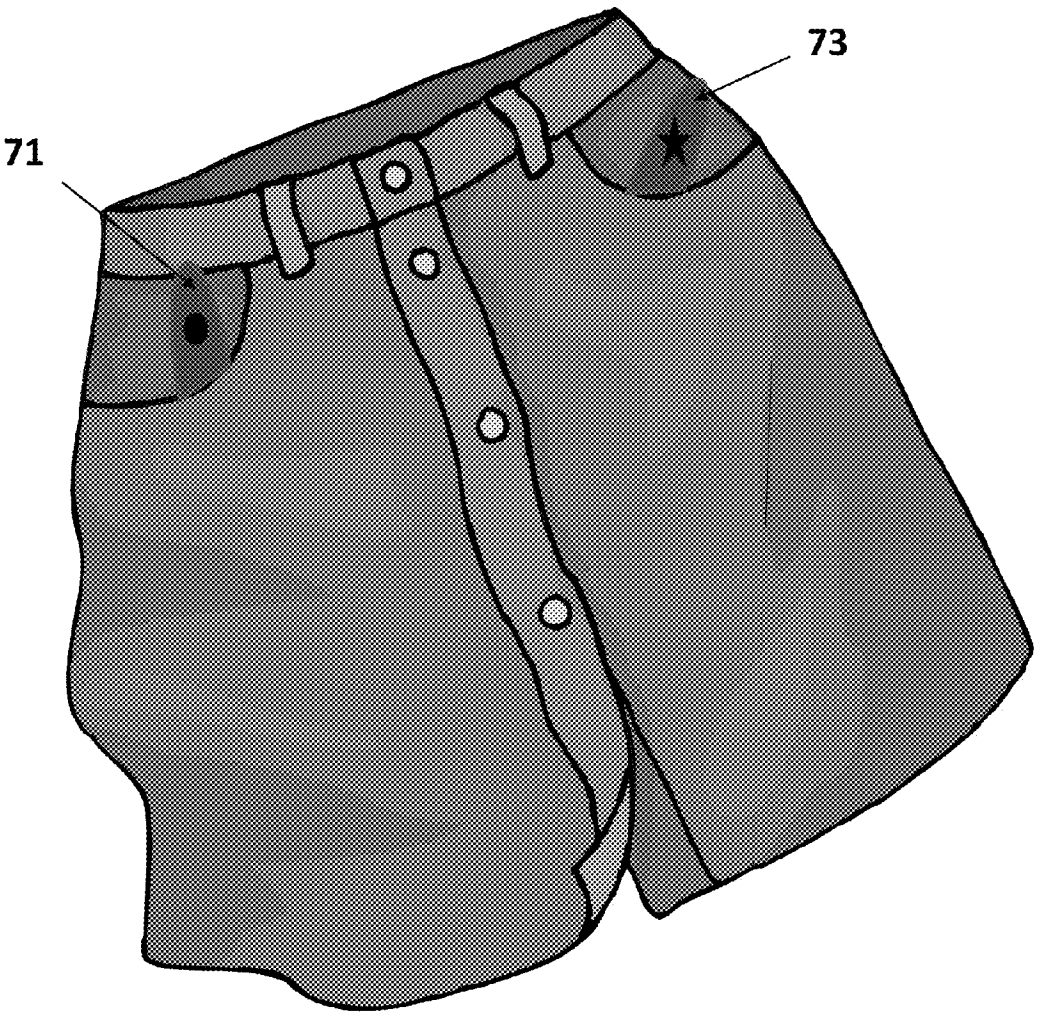
FIG. 7 is another illustration of example placement of objects.

FIG. 7 is another illustration of example placement of objects. For example, locations 72 and 78 as depicted in FIG. 6, may depict locations inside of the respective pockets. The objects placed at these location may comprise a tag, or the like (71, 73), that can be lifted or unfolded out of a pocket to observe the object placed thereon. Tags or the like, as depicted in FIG. 7 (71, 73) may be utilized in any appropriate manner on any embodiments depicted herein.

Figure 8:
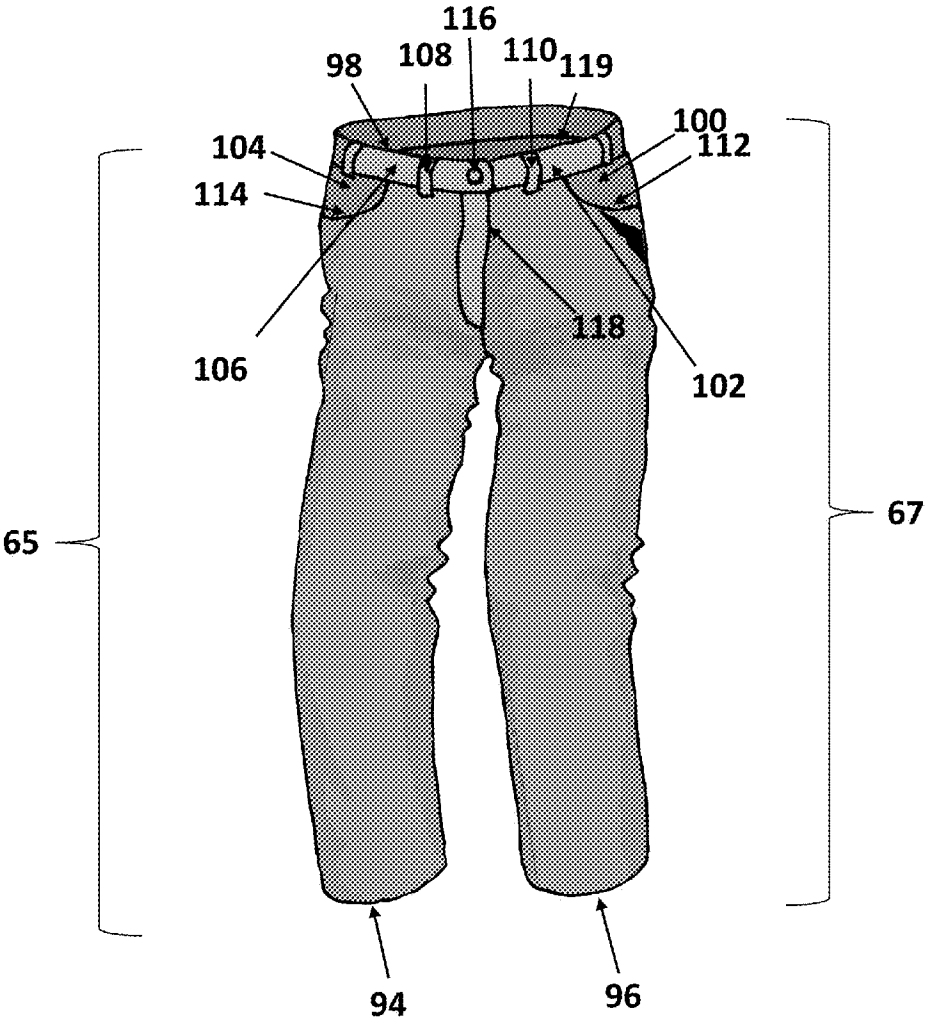
FIG. 8 is another illustration of example placement of objects.

FIG. 8 is another illustration of example placement of objects. As depicted in FIG. 8, objects may be placed on various portions of a garment, such as, for example, the right side 65 and/or the left side 67 of the pant depicted in FIG. 8. Objects may be placed at any appropriate location, such as, for example, approximate to the right pocket (104, 114), approximate to the left pocket (100, 112), approximate to right side inner waste band 98 (back and/or front), approximate to left side inner waste band 119 (back and/or front), approximate to right side outer wasted band 106 (back and/or front), approximate to left side outer waste band 102 (back and/or front), approximate to right side belt loop 108 (any appropriate belt loop or combination of belt loops), approximate to left side belt loop 110 (any appropriate belt loop or combination of belt loops), approximate to fastener (e.g., button, snap, zipper, etc.) 116, approximate to flap 118 (e.g., zipper flap), approximate to right side inner and/or pant leg 94, approximate to left side inner and/or outer pant leg 96, or any appropriate combination thereof.

Figure 9:
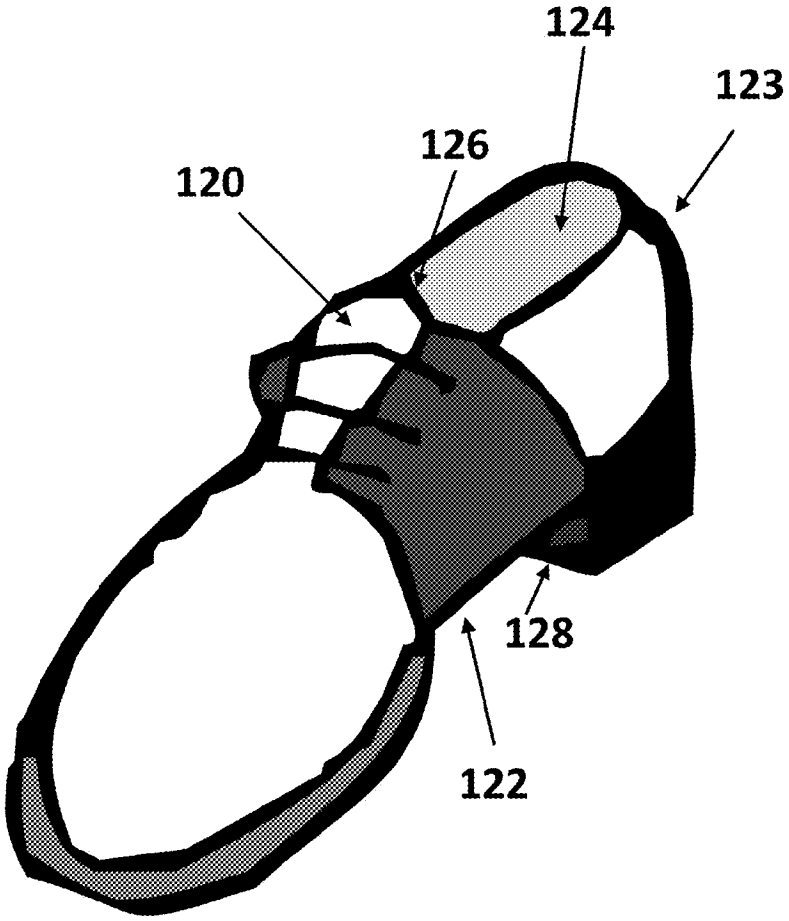
FIG. 9 is another illustration of example placement of objects.

FIG. 9 is another illustration of example placement of objects. As depicted in FIG. 9, objects may be placed on various portions of a garment, such as, for example, the right shoe depicted in FIG. 9. Objects may be placed at any appropriate location, such as, for example, approximate to outer portion 120 of shoe tongue, approximate to the inner portion 126 of the shoe tongue, approximate to the inner portion 124 of the shoe, approximate to the heel portion 123 of the shoe, approximate to lower heel portion 128 of the shoe, approximate to the underside 122, or any appropriate combination thereof. An object, or objects, may be placed on a strap, a shoe lace, or the like, of footwear, or any appropriate combination thereof (not depicted in FIG. 9).

Figure 10:
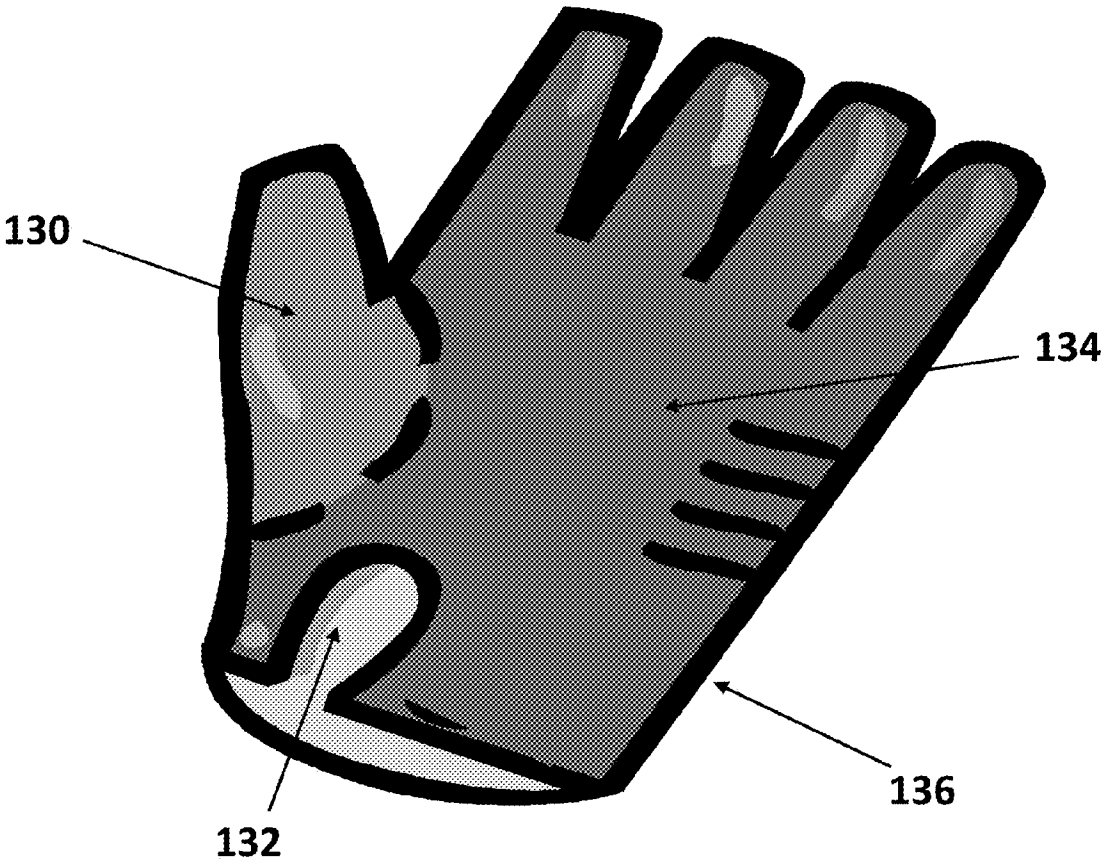
FIG. 10 is another example illustration of placement of objects.

FIG. 10 is another example illustration of placement of objects. As depicted in FIG. 10, objects may be placed on various portions of a garment, such as, for example, the left glove depicted in FIG. 10. Objects may be placed at any appropriate location, such as, for example, approximate to a thumb portion 130, approximate to an inner portion 132 of the glove, approximate to a palm portion 134 of the glove, approximate to a back hand portion 136 of the glove, or any appropriate combination thereof.

Figure 11:
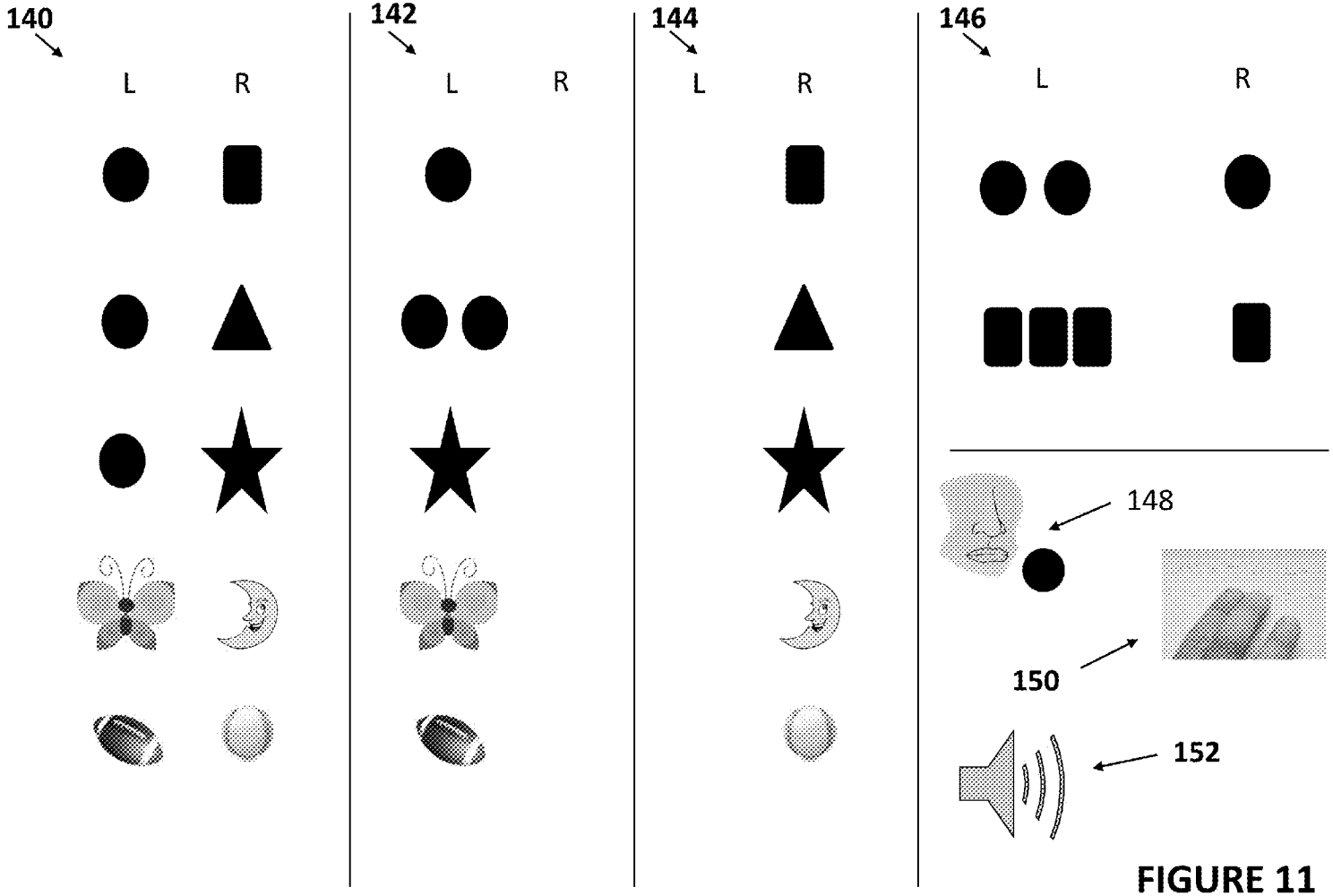
FIG. 11 depicts example illustrations of objects.

FIG. 11 depicts example illustrations of objects. An object may comprise any appropriate shape and any appropriate number of objects. For example, objects may be color coded, shaped, personalized, and/or comprise any appropriate number of objects in order to aid in distinguishing first objects from second objects, and to compare similar looking objects. Objects may have tactile differences such that a difference between objects may be ascertainable via touch. Objects may have aromatic differences such that a difference between objects may be ascertainable via olfactory senses (e.g., sense of smell). Objects may comprise audible differences such that a difference between objects may be ascertainable via auditory senses (e.g., sense of hearing). FIG. 11 depicts example combinations of objects and types of objects. For example, panel 140 of FIG. 11 illustrates example combinations of objects. L represents a left side or a left article of handwear/foot wear, and R represents a right side or right article of handwear/footwear. Panel 142 illustrates combinations of objects in which objects may be placed on the left and not on the right. Panel 144 illustrates combinations of objects in which objects may be placed on the right and not on the left. Panel 146 illustrates combinations of objects in which multiple objects may be used. Object 148 illustrates an object that may be detected via an olfactory sense. The object of 148 may be a "scratch and sniff" type object, a cologne and/or perfumed object, or the like. Object 150 illustrates an object that may be detected via a tactile sense, such as a sense of touch. The object 150 may comprise braille, a tactile shape, or the like, or any appropriate combination thereof. Object 152 illustrates an object that may be detected via auditory senses (e.g., sense of hearing). In various example embodiments, a sound, tone, song, jingle, ringtone, spoken word, etc. may be emitted from the object. The emission may be triggered by touching an object, by moving an object, via voice command to the object, via transmission from a device (e.g., mobile device, MP3 player, etc.) via a wireless connection, or any appropriate combination thereof. In various example embodiments, the object may be configured to receive downloads of audio content. Thus, audio content could be changed and updated as desired.

In various example embodiments, an object may comprise a light, light emitting diode, or the like that emits light when triggered. The emitted light may be in the form of any object shape as described herein, a blinking light, pattern of light, color (or colors) of light, or the like, or any appropriate combination thereof. Triggering may be via touching an object, by moving an object, via voice command to the object, via transmission from a device (e.g., mobile device, MP3 player, etc.) via a wireless connection, or any appropriate combination thereof. In various example embodiments, the object may be configured to receive downloads of video content. Thus, video content could be changed and updated as desired.

Figure 12:
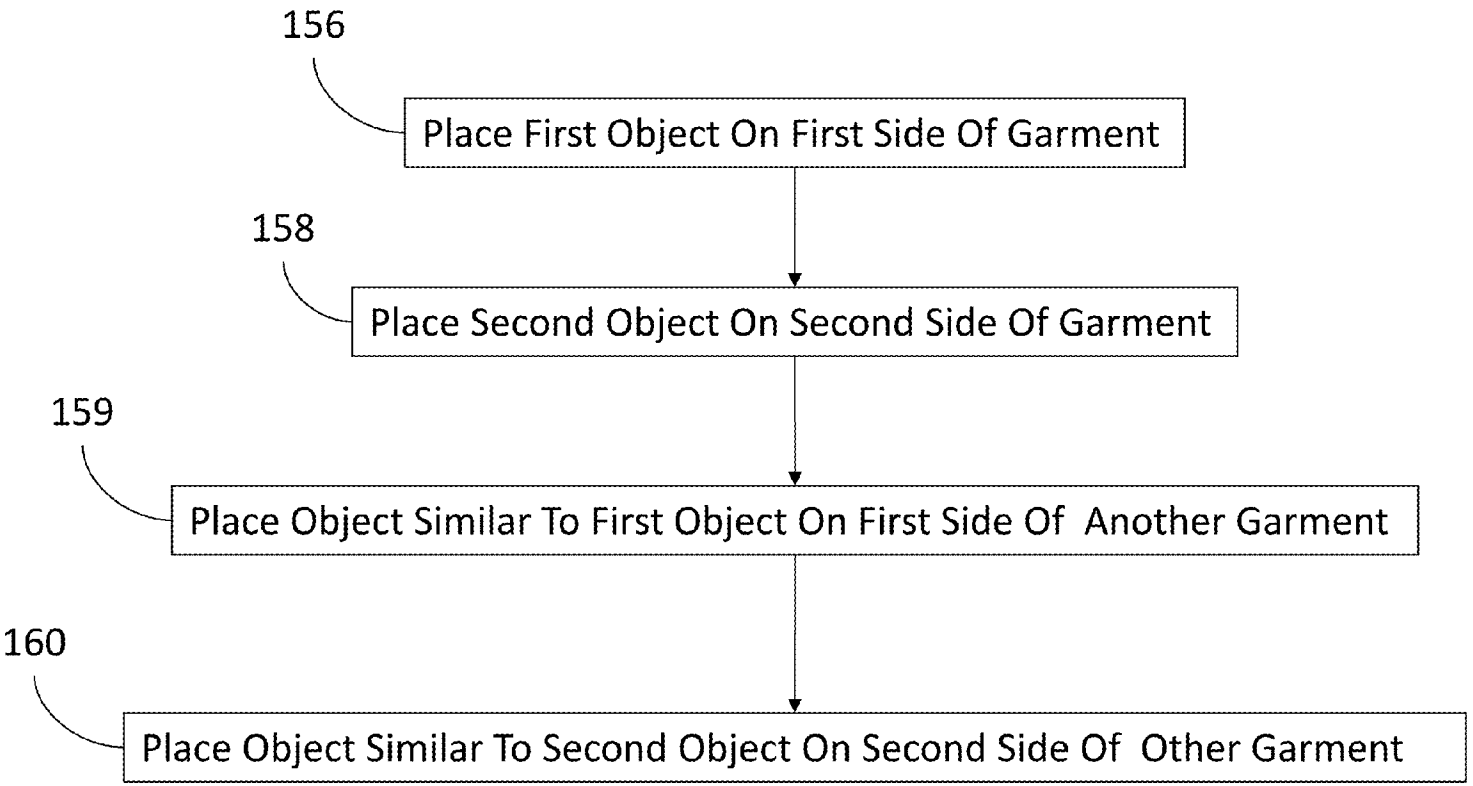
FIG. 12 is a flow diagram depicting an example process of placing objects on apparel.

FIG. 12 is a flow diagram depicting an example process for placing objects on apparel. A first object is placed on a first side of a garment at step 156. A second object is placed on a second side of a garment at step 158. An object similar to the first object is place on the first side of another garment at step 159. And, an object similar to the second object is place on the second side of the other garment at step 160. It is to be understood that the order of the steps depicted in FIG. 12 does not necessarily have to be in the order depicted. Further, as described herein, any appropriate object and/or number of objects may be placed at any appropriate location or locations of garments, handwear, footwear, etc.

Figure 13:
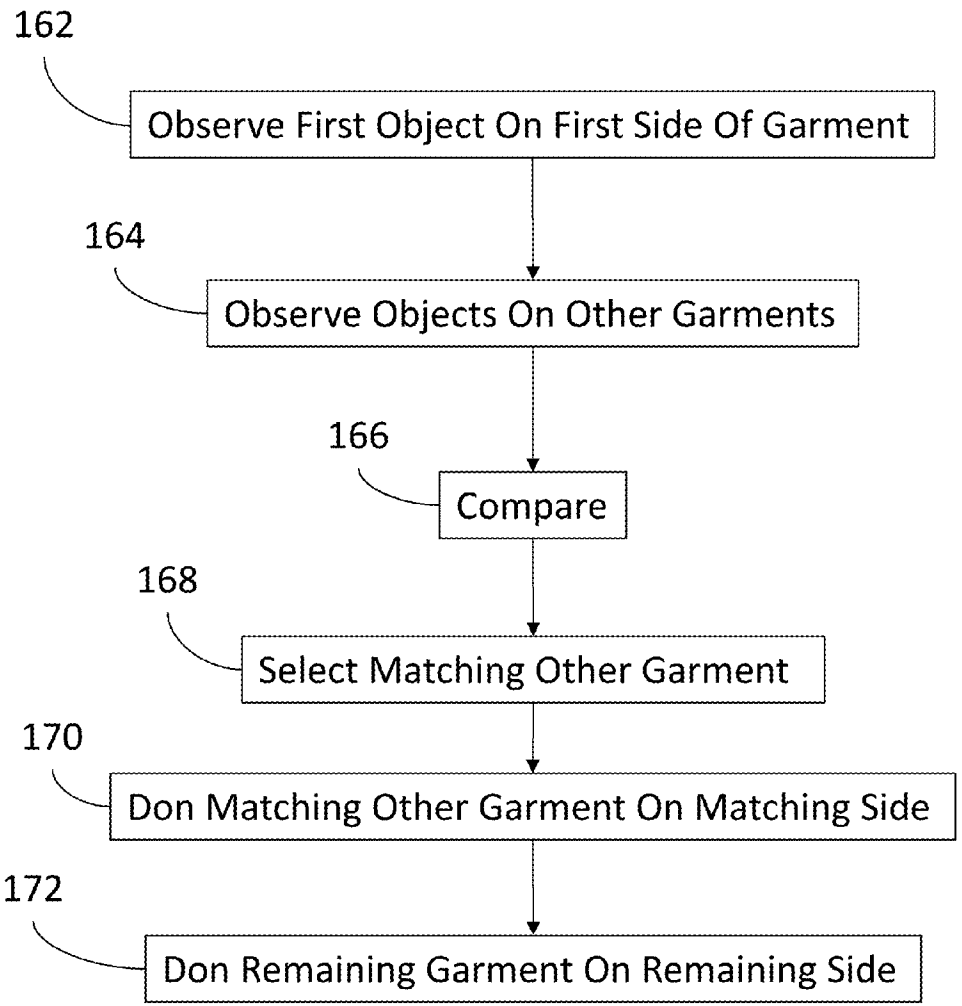
FIG. 13 is a flow diagram depicting an example process of utilizing an aid for applying apparel.

FIG. 13 is a flow diagram depicting an example process of utilizing an aid for applying apparel. The first object on the first side of the garment is observed at step 162. It is to be understood that observation may be accomplished via any sense or combination of senses as described herein. Objects on the other garments are observed at step 164. The observations are compared at step 166. A garment having an object that matches is selected at step 168. The selected garment is donned on the matching side at step 170. The remaining garment is donned on the other side at step 172.

Figure 14:
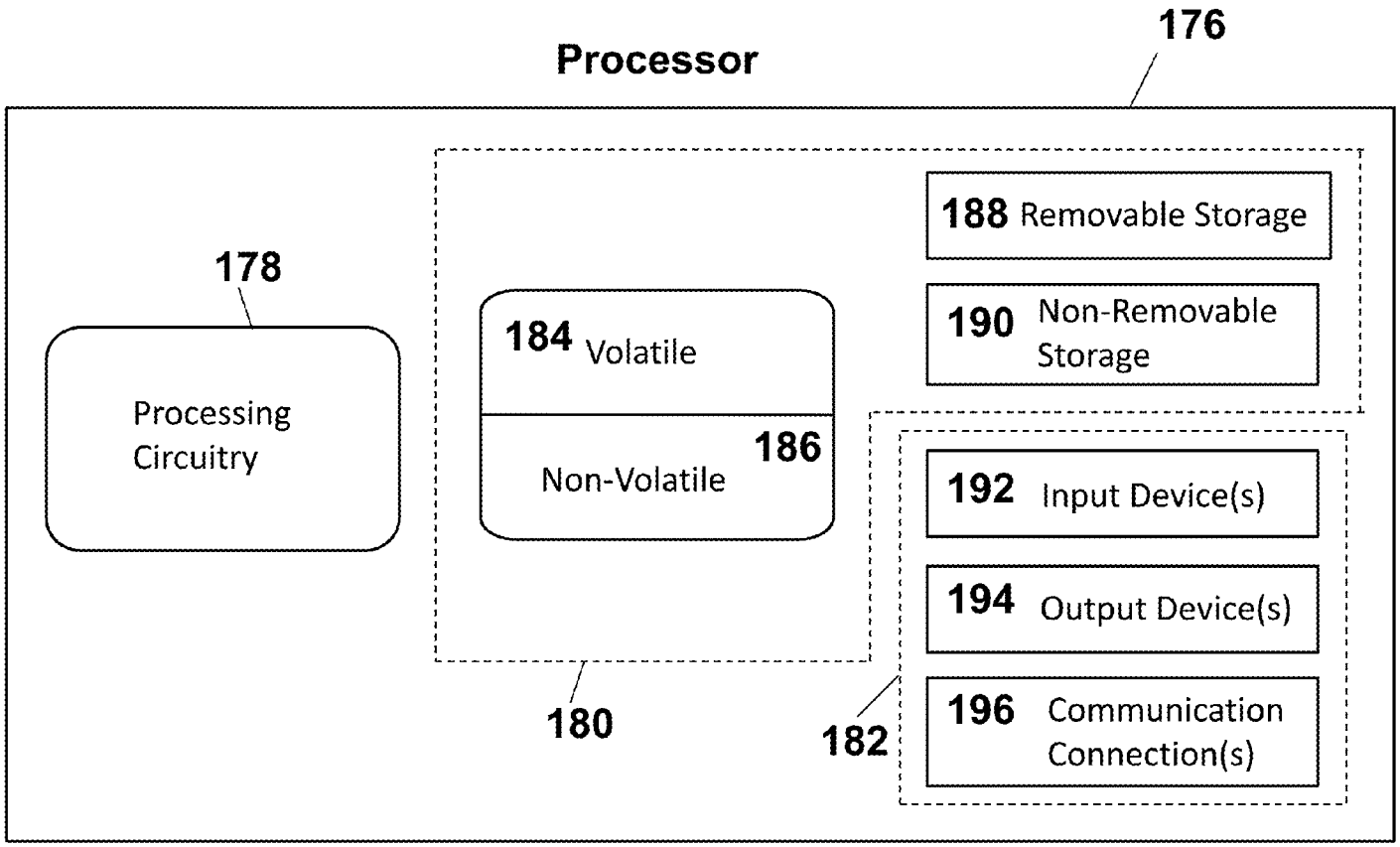
FIG. 14 is a block diagram of an example processor configurable to communicate with an object.

FIG. 14 is a block diagram of an example processor 176 configurable to communicate with an object. The processor 176 depicted in FIG. 14 represents any appropriate processor, apparatus, or combination of processors or apparatuses, such as, a server, a gateway, etc., or any combination thereof. In an example embodiment, the processor 176 comprises hardware, or a combination of hardware and software. And, each portion of the processor 176 comprises hardware, or a combination of hardware and software. The functionality needed to communicate with an object can reside in any one or combination of processors. It is emphasized that the block diagram depicted in FIG. 14 is an example and not intended to imply a specific implementation or configuration. Thus, the processor 176 can be implemented in a single processor or multiple processors (e.g., single server or multiple servers, single gateway or multiple gateways, etc.). Multiple processors can be distributed or centrally located. Multiple processors can communicate wirelessly, via hard wire, or a combination thereof.

In an example configuration, the processor 176 comprises processing circuitry 178, memory circuitry 180, and input/output circuitry 182. The processing circuitry 178, memory circuitry 180, and input/output circuitry 182 are coupled together (coupling not shown in FIG. 14) to allow communications therebetween. The input/output circuitry 182 is capable of receiving and/or providing information from/to an object and/or any other processor and/or processors configurable to be utilized to communicate with an object. For example, the input/output circuitry 182 may be capable of, in conjunction with any other portion of the processor 176 as needed, provide and/or receive information pertaining to triggering an object, uploading content, downloading content, or the like, or any combination thereof.

The processing circuitry 178 may be capable of performing functions associated with communicating with an object, as described herein. For example, the processing circuitry 178 can be capable of triggering an object, uploading content, downloading content, or the like, or any appropriated combination thereof.

The memory circuitry 180 can store any information utilized in conjunction with communicating with an object, as described herein. For example, the memory portion 180 may be capable of storing information pertaining to triggering an object, uploading content, downloading content, or the like, or any appropriated combination thereof. Depending upon the exact configuration and type of processor 176, the memory circuitry 180 can include a computer storage medium, or media, that is volatile 184 (such as dynamic RAM), non-volatile 186 (such as ROM), or a combination thereof. The processor 176 can include additional storage, in the form of computer storage media (e.g., removable storage 188 and/or non-removable storage 190) including, RAM, ROM, EEPROM, tape, flash memory, smart cards, CD-ROM, digital versatile disks (DVD) or other optical storage, magnetic cassettes, magnetic tape, magnetic disk storage or other magnetic storage devices, universal serial bus (USB) compatible memory. As described herein, a computer storage medium is an article of manufacture and not a transient signal.

The processor 176 also can contain communications connection(s) 196 that allow the processor 176 to communicate with other devices, objects, or the like. A communications connection(s) can comprise communication media. Communication media can be used to communicate computer readable instructions, data structures, program modules, or other data. Communication media can include an appropriate transport mechanism or information delivery media that can be used to transport a modulated data signal such as a carrier wave.

The processor 176 also can include input device(s) 192 such as keyboard, mouse, pen, voice input device, touch input device, an optical input device, etc. Output device(s) 194 such as a display, speakers, printer, mechanical vibrators, etc. also can be included.

While an apparel application aid has been described in connection with the various embodiments of the various figures, it is to be understood that other similar embodiments can be used or modifications and additions can be made to the described embodiments for an apparel application aid without deviating therefrom.

What is claimed:

1. A system comprising:

a depiction of a first object positioned at a first location on a first appendage of a first type of apparel;

a depiction of a second object positioned at a second location on a second appendage of the first type of apparel;

a depiction of the first object at a third location on a second type of apparel, wherein:

the first type of apparel differs from the second type of apparel;

the first object differs from the second object; and an orientation for donning the second type of apparel is determinable based on:

the first location; and the third location; and the depiction of the first object comprises an audible depiction; and the depiction of the second object comprises an audible depiction.

2. The system of claim 1, further comprising:

a depiction of the second object at a fourth location on the second type of apparel, wherein an orientation for donning the second type of apparel is determinable based on:

the first location;

the second location;

the third location; and the fourth location.

3. The system of claim 1, wherein the second type of apparel comprises a first component and a second component, the system further comprising:

the third location being on the first component;

a depiction of the second object at a fourth location on the second component, wherein:

an orientation for donning the first component is determinable based on the first location and the third location; and an orientation for donning the second component is determinable based on the second location and the fourth location.

4. The system of claim 1, wherein:

the depiction of the first object further comprises a visual depiction; and the depiction of the second object further comprises a visual depiction.

5. The system of claim 1, wherein:

the depiction of the first object further comprises a tactile depiction; and the depiction of the second object further comprises a tactile depiction.

6. The system of claim 1, wherein the second apparel comprises at least one of handwear or footware.

7. A system comprising:

a depiction of a first object positioned at a first location on a first appendage of a first type of apparel;

a depiction of a second object positioned at a second location on a second appendage of the first type of apparel;

a depiction of the first object at a third location on a second type of apparel, wherein:

the first type of apparel differs from the second type of apparel;

the first object differs from the second object; and an orientation for donning the second type of apparel is determinable based on:

the first location; and the third location; and the depiction of the first object comprises an olfactory depiction; and the depiction of the second object comprises an olfactory depiction.

8. The system of claim 7, further comprising a depiction of the second object at a fourth location on the second type of apparel, wherein:

an orientation for donning the second type of apparel is determinable based on:

the first location;

the second location;

the third location; and the fourth location.

9. The system of claim 7, wherein the second type of apparel comprises a first component and a second component, the system further comprising:

the third location being on the first component;

a depiction of the second object at a fourth location on the second component, wherein:

an orientation for donning the first component is determinable based on the first location and the third location; and an orientation for donning the second component is determinable based on the second location and the fourth location.

10. The system of claim 7, wherein:

the depiction of the first object further comprises a visual depiction; and the depiction of the second object further comprises a visual depiction.

11. The system of claim 7, wherein:

the depiction of the first object further comprises a tactile depiction; and the depiction of the second object further comprises a tactile depiction.

12. The system of claim 7, wherein the second apparel comprises at least one of handwear or footware.

* * * * *